US007771259B2

(12) United States Patent
Pettit

(10) Patent No.: US 7,771,259 B2
(45) Date of Patent: Aug. 10, 2010

(54) FLUSH MOUNTED FRAME FOR AN ACCESS PANEL OR REGISTER

(76) Inventor: Michael Pettit, 98 Donald Ave., Newbury Park, CA (US) 91320

( * ) Notice: Subject to any disclaimer, the term of this patent is extended or adjusted under 35 U.S.C. 154(b) by 188 days.

(21) Appl. No.: 11/232,295

(22) Filed: Sep. 20, 2005

(65) Prior Publication Data

US 2007/0066214 A1 Mar. 22, 2007

(51) Int. Cl.
*F24F 7/00* (2006.01)

(52) U.S. Cl. ..... 454/289

(58) Field of Classification Search ..... 454/289, 454/370; 40/785

See application file for complete search history.

(56) References Cited

U.S. PATENT DOCUMENTS 2,654,451 A * 10/1953 Schmidgall ..... 40/785
4,026,082 A * 5/1977 Crofoot ..... 52/302.7
4,319,520 A * 3/1982 Lanting et al. ..... 454/290
4,566,724 A 1/1986 Arnoldt et al.
5,100,445 A 3/1992 Johnson et al.
5,303,488 A * 4/1994 Todd et al. ..... 40/785
5,472,380 A 12/1995 Sarazen, Jr. et al.
5,928,078 A 7/1999 Moore et al.
5,950,384 A * 9/1999 Aarness ..... 52/473
6,234,894 B1 * 5/2001 Goracke et al. ..... 454/290
6,908,115 B2 6/2005 Synder

* cited by examiner

*Primary Examiner*—Steven B McAllister
*Assistant Examiner*—Samantha A Miller
(74) *Attorney, Agent, or Firm*—Gene Scott; Patent Law & Venture Group

(57) ABSTRACT

A frame apparatus capable of being flush mounted relative to a wall, ceiling or floor surface, is made up by joining linear frame sections each providing interconnected elements formed by an extrusion process. A first planar element is spaced apart from a second planar element and positioned for abutting a common surface. A first channel element is formed between the first and second planar elements. A third planar element is positioned normal to the first and second planar elements and terminates with a rib directed toward the first planar element. When mounted onto studs in a building structure, wall putty or mud may be placed into a space between the wall panels and the third planar element and with rib elements protruding from the third planar element, the mud is captured in place forming a smooth interface between the frame assembly and the surrounding wall surfaces.

4 Claims, 5 Drawing Sheets

FLUSH MOUNTED FRAME FOR AN ACCESS PANEL OR REGISTER

RELATED APPLICATIONS

This application is related to a U.S. Provisional Patent Application Ser. No. 60/605,978, filed on Aug. 31, 2004.

BACKGROUND

1. Field of the Present Disclosure

This disclosure relates generally to access panels and heating registers and more particularly to a frame construction and method of mounting the frame for receiving an access panel or heating register.

2. Description of Related Art

Moore, et al., U.S. Pat. No. 5,928,078, discloses a connection flange used to fasten a floor register to a precut hole while providing a connection for an air duct fitting. A face with a generally rectangular inner and outer perimeter has a tubular member with a first end extending from the inner perimeter of the face and a second end, the tubular member contains a continuous channel open to the second end to allow insertion of an end portion of the fitting. The channel has a plurality of teeth extending into the channel to provide a retaining means for the fitting. The fitting comprises one or more protuberances located along the surface of the fitting adjacent to the end portion of the fitting, where the protuberances are positioned to allow movement of the fitting only in a direction which moves the fitting closer to the face. Snyder, U.S. Pat. No. 6,908,115, discloses a register opening cover used to cover register openings until a register boot is installed in the register opening. During the installation of the register boot, the invention may be used to hold the register boot in place until the register boot is securely connected to the floor. After the register boot is installed, the cover forms an insulator around the register boot. One embodiment of the invention provides a register opening cover and register boot frame that can be configured to fit register boots of different sizes. Another embodiment of the invention provides a register opening cover that will support some of the weight of a worker who may step on the covered register opening. Sarazen, Jr., et al., U.S. Pat. No. 5,472,380, discloses a modular forced-air register including two main sub-assemblies. A housing with an opening can be disposed into a hole in the floor of a room. A second sub-assembly includes a louver plate with a grid work of tri-directional vanes. Air flow is controlled by a slide grille disposed beneath the grid work and carrying an integral filter substrate secured to the slide grille. The two sub-assemblies are detachably connected to each other by an arrangement of bosses and recesses as well as a projection mounted on a flexible tang configured and disposed to engage a pocket configured in a thin wall region of the opposing sub-assembly. Arnoldt, et al., U.S. Pat. No. 4,566,724, discloses a plurality of flange members positioned oppositely of one another on the ends of a pair of generally rectangular sheet metal ducts. The flange members are positioned in pairs on the adjacent ends of the ducts. The angular legs of corner pieces extend into the ends of the flange members to connect the adjacent flange members on the end of each duct so that four corner pieces connect the flange members to form a frame around the respective duct end portion. The oppositely positioned flange members on the adjacent duct end portions are sealingly secured together by clamping together the adjacent corner pieces. Each flange member is formed by a thin walled sheet member and includes a pair of legs angularly disposed relative to one another to form a plurality of wall sections. A first wall section terminates in a first leg end portion, and a second wall section terminates in a second leg end portion. The first and second leg end portions are spaced apart. The first and second wall sections are positioned in overlying relation to receive the duct end portion therebetween. The duct end portion overlies the second wall section which extends around and below the duct end portion to a stop on the second leg end portion. The stop engages a plurality of protuberances or dimples on the surface of the duct adjacent the duct end portion to prevent retraction of the duct end portion from the flange member. The first leg end portion forms an abutment shoulder, and the duct end portion engages the abutment shoulder. Thus, the duct is rigidly secured between the stop and the abutment shoulder, thereby, eliminating freedom of movement between the flange wall sections to provide a torsionally rigid connection of each flange member to the duct end portion that resists bending of adjacent flange members away from each other to prevent air leakage at the duct joint. Johnson, et al., U.S. Pat. No. 5,100,445, A disposable filter for heating and ventilating registers wherein a supporting framework includes apertures with removable cover portions which permit selective air flow, means for securing the framework to the register or adjacent structural members and re-closable means for admitting a filter element to an interior cavity. In alternative configurations, differing filter media or replacement media may be mounted to the framework. A separately attached border trim may also be included for oversize registers. Also considered is a finish cover including means for retaining the filter to the cover and the cover to the ductwork port.

Our prior art search described above teaches the construction of registers including register frames. However, the prior art fails to teach a simple extruded frame made up of linear sections and joined by L-shaped tab elements. The present disclosure distinguishes over the prior art providing heretofore unknown advantages as described in the following summary and detailed description.

SUMMARY

This disclosure teaches certain benefits in construction and use which give rise to the objectives described below.

A frame apparatus capable of being flush mounted relative to a wall, ceiling or floor surface, is made up by joining linear frame sections each providing interconnected elements formed by an extrusion process. A first planar element is spaced apart from a second planar element and positioned for abutting a common surface. A first channel element is formed between the first and second planar elements. A third planar element is positioned normal to the first and second planar elements and terminates with a rib directed toward the first planar element. When mounted onto studs in a building structure, wall putty or mud may be placed into a space between the wall panels and the third planar element and with rib elements protruding from the third planar element, the mud is captured in place forming a smooth interface between the frame assembly and the surrounding wall surfaces.

A primary objective inherent in the above described apparatus and method of use is to provide advantages not taught by the prior art.

Another objective is to provide a HVAC register frame that is easily assembled and mounted on site.

A further objective is to provide such a register frame that is made by extruding metal or plastic for low cost manufacture.

A yet further objective is to provide such a register frame that is designed to mud-in the frame for a smooth flush appearance.

Other features and advantages of the described apparatus and method of use will become apparent from the following more detailed description, taken in conjunction with the accompanying drawings, which illustrate, by way of example, the principles of the presently described apparatus and method of its use.

BRIEF DESCRIPTION OF THE DRAWINGS

The accompanying drawings illustrate at least one of the best mode embodiments of the present apparatus and method of it use. In such drawings.

DETAILED DESCRIPTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 4:
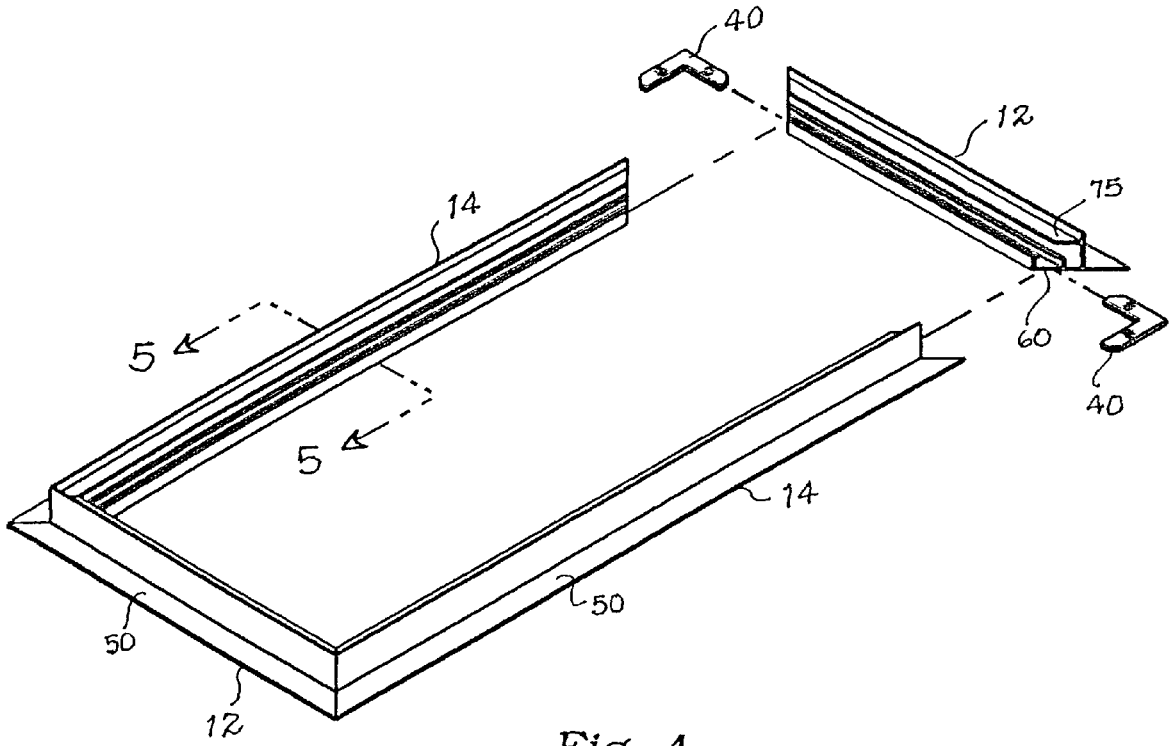
FIG. 4 is a perspective view of the frame showing a method of assembly.

The presently described apparatus is a frame assembly 10 and register 20 capable of being flush mounted relative to a surface 30 of, for instance, a wall, ceiling or floor, interior to a building space. The frame assembly 10, as shown in FIG. 4, is made up of a plurality of interconnected straight frame sections 12, 14, short and long sections respectively. The sections 12, 14 are, in turn, made up from a plurality of interconnected elements and may take several distinct forms, all of which subscribe to a common configuration or set of structural principal arrangements to achieve the above described objectives. Two such distinct forms are described herein, but it should be recognized that other forms or embodiments of the present apparatus may be conceived by those of skill in the art without diverging from the principals of the present disclosure.

Figure 3:
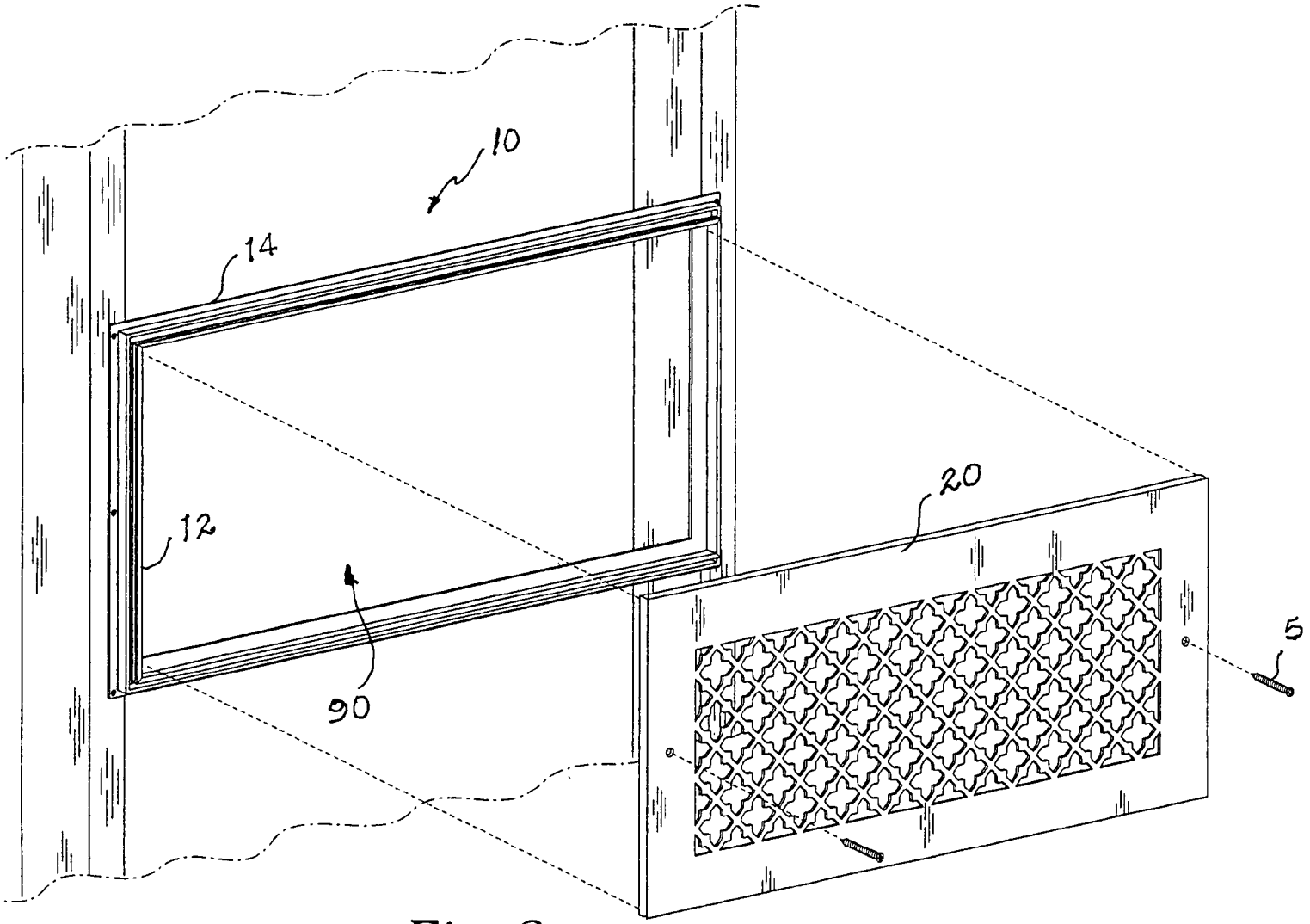
FIG. 3 is a perspective view thereof with the register shown spaced away from the frame and studs to reveal further details and a method of assembly.
Figure 5:
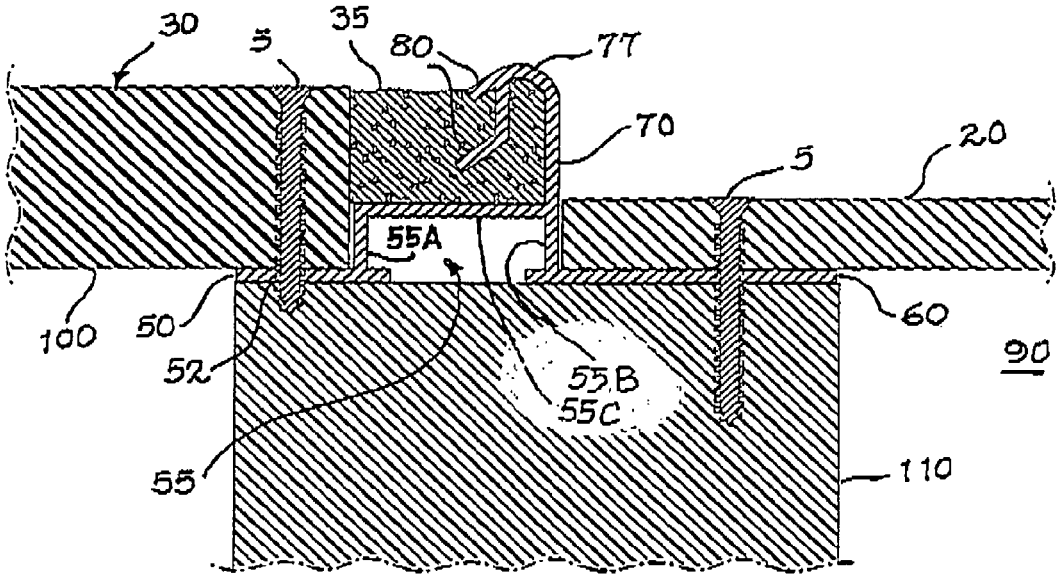
FIGS. 5 and 6 are section views of a first and second embodiments respectively thereof taken along line 5-5 in FIG. 4.
Figure 6:
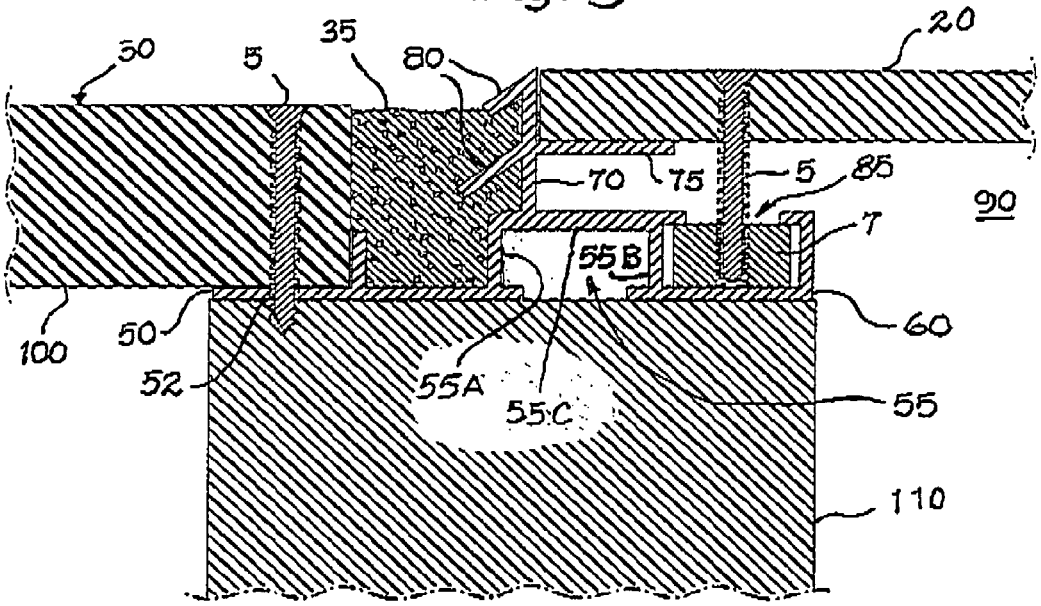

Frame assembly 10, as described herein is comprised of four linear frame sections 12, 14 which are joined together at their ends to form the open assembly shown in FIG. 3 which depicts an elongate rectangular frame assembly 10, although the frame assembly may be square rather than elongate. The frame sections 12, 14 may be made of metal or plastic materials and, it is noted, as shown in FIGS. 5 and 6, that they are configured to be made by an extrusion process so as to be produced economically. In order to join the individual sections 12, 14 to each other, as shown in FIG. 4, the sections are mitered at each of their ends and joined using right angle tabs 40 as shown in FIG. 4, a technique well known in the picture frame industry, i.e. picture frames are available at retail as sets of four linear picture frame sections having grooves for receiving right angle tabs 40 so that a rectangular picture frame may be easily and quickly assembled. This same technique is employed to assemble the frame assembly 10 from the four frame sections 12, 14.

Referring now to FIGS. 5 and 6, each of the frame sections 12, 14 is made up of certain elements which are interconnected to achieve the advantageous results shown in the attached figures. Referencing to these elements now, the linear sections 12, 14 all have in common, a first planar element 50 providing a mounting hole 52, although certain of the linear sections 12, 14 may not have mounting hole 52, as for instance as shown in FIG. 3 or the frame may be mounted without hardware by using adhesives in which case no mounting hole need be used. A second planar element 60 is spaced apart from the first planar element 50 and is positioned for abutting a common surface, i.e., the elements 50 and 60 are coplanar as shown. Between the elements 50 and 60 is formed a first channel 55 which is used with the right angle tabs 40 to join each section 12 at both of its mitered ends to each section 14 at its mitered ends as shown in FIG. 4. A third planar element 70 is normal to the first 50 and second 60 planar elements and terminates distally with a rib element 80 which is directed toward the first planar element 50. It should be noted that rib element 80 may comprise one or more separate portions as shown in FIGS. 5 and 6, and these separate portions shall all be referred to herein as "rib element 80." The function of each of the elements 50-80 will be described presently.

The frame assembly 10 forms a closed configuration defining an aperture 90 as best shown in FIG. 3. As noted, the closed configuration is preferably rectangular in that the presently described apparatus is typically used with the access panel or register 20 at the termination of an air duct (not shown) and such ducts are usually rectangular in their cross-section. Alternately, the frame assembly 10 may take other shapes including round, hexagonal, etc. as necessary.

The presently described apparatus further comprises the register 20, which may also be referred to as a vent, a grill, a screen and other descriptions, but which are all of the same nature; primarily a planar, or near planar panel with opening in it for air or other fluids to pass through. The register 20 which covers the aperture 90 is secured to the frame assembly 10 using common fasteners 5 driven through the second planar element 60 (FIG. 5) or into a fastener receiver 7 such as a nut (FIG. 6) which is held, in turn, by a second channel 85 associated with the second planar element 60. As shown in FIG. 5, the third planar element 70 and the rib element 80 are preferably joined by an arcuate element 77 peripheral to the register 20.

As shown in FIG. 6, a fourth element 75 is normal to, and extends laterally from the third planar element 70. This fourth planar element 75 forms a ridge in the frame assembly 10 upon which the register 20 is placed as shown.

Referring now specifically to FIGS. 3, 5 and 6, the open frame assembly apparatus described above is described now with more particularity and is directed to amended Pigs. 5 and 6. The open frame assembly has at least three, but preferably four extruded, longitudinally extensive, frame sections such as shown in FIG. 3 with reference numerals 12 and 14. Each of the frame sections 12, 14 has a pair of laterally spaced-apart, longitudinally extensive, coplanar, first 50 and second 60 planar elements which together define and form a base of each of the frame sections 12 and 14. The term "base" is appropriate here in that elements 50 and 60 are mounted onto structural building element 110 (FIGS. 5 and 6), and all further parts or elements of the frame sections 12 and 14 extend away from elements 50 and 60 and are therefore ultimately supported by the base. First channel 55 comprises a pair of laterally spaced-apart, parallel legs 55A and 55B which are each longitudinally extensive, and each is joined with one of the first 50 and second 60 planar elements, as shown. The parallel legs 55A, 55B extend away from the base. First channel 55 also includes a longitudinally extensive leg-joining planar element 55C which extends between, and is joined to, the parallel legs 55A and 55B. A longitudinally extensive third planar element 70 is joined to the leg-joining planar clement 55C and extends away from the base. The third planar element 70 terminates distally from the base at one or more rib elements 80 which are directed obliquely toward the base; in FIGS. 5 and 6, toward the first planar element 50. Preferably, the register 20 is mounted on the second planar element 60 or in general, on the base as shown in FIG. 5. As shown in FIG. 6, the frame sections each have a longitudinally extensive fourth planar element 75 that is joined to the third planar element 70 in a position spaced apart from, and parallel to, the leg-joining planar element 55C. Alternately, the register 20 may be mounted on the fourth planar elements 75 of the frame sections 12, 14 as shown in FIG. 6. The term "longitudinally extensive," as applied to the several elements defined above and shown best in FIGS. 5 and 6, means that the elements extend the full length, or nearly the full length of the longitudinally extensive, frame sections 12 and 14 as shown in FIGS. 3 and 4. The term "lateral" means; in a direction normal to the longitudinal direction, i.e., across the frame section 12 or 14, and with reference to *Figs*. 5 and 6, left to right in the drawings. The term "planar" means a thin flat portion of the extrusion having opposing flat and planar sides defining a relatively thin part.

Figure 1:
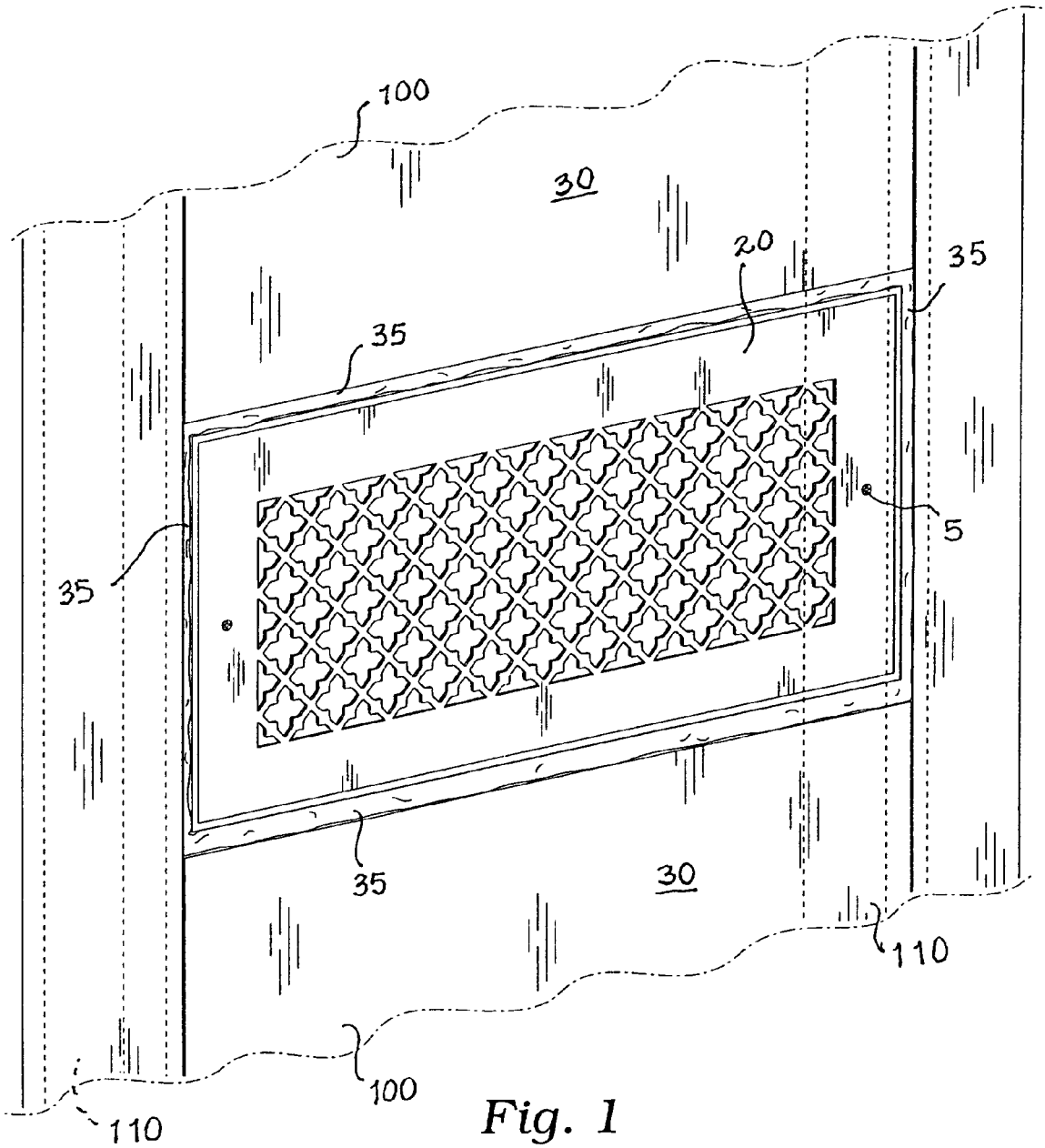
FIG. 1 is a perspective view of a HVAC register of the present disclosure secured within a frame of the present disclosure that is flush mounted in a wall.
Figure 2:
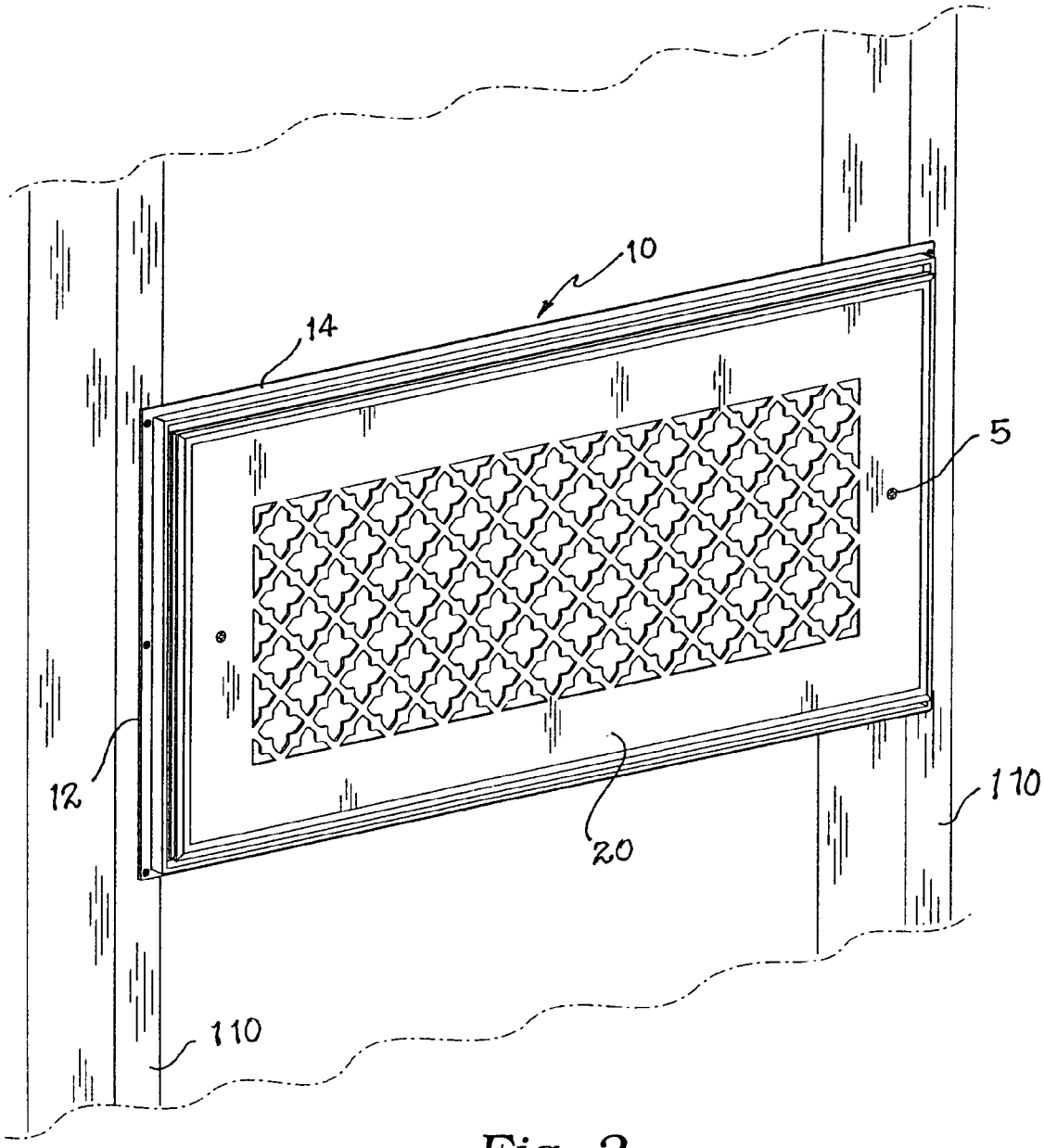
FIG. 2 is a perspective view thereof shown with wall portions removed to expose spaced apart studs upon which the frame is fastened.

The preferred method of use of the present apparatus as described above and shown in the drawing figures includes joining the frame sections 12, 14 to make up the frame assembly 10 using the L-shaped tabs 40, and then placing wall sections 100 in contact with the first planar elements 50 of the frame assembly 10 and securing the wall sections 100 and the frame assembly 10 in place by driving fasteners 5 through the wall sections 100 and the first planar elements 50 and then into structural building elements 110 such as wall studs. This is as shown in FIGS. 5 and 6. Alternately, the frame assembly 10 is secured to the building elements 110 first as shown in FIG. 2, and then the wall sections 100 are placed as shown in FIGS. 5 and 6 and anchored into place. Next, the gap between the wall sections 100 and the second planar elements 60 are filled with a trowled material 35 such as dry wall "mud" or similar fill and smoothing product well known in the art, as shown in FIGS. 5 and 6 so that a smooth wall surface terminates at the frame assembly 10 as shown in FIGS. 5 and 6. Finally, the register 20 is fastened to the frame assembly 10 using fasteners 5 which are either driven into tapped holes in the second planar elements 60 (FIG. 5), or into nuts 7 secured within the second channel elements 85, as shown in FIG. 6.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A longitudinally extensive, extruded, one piece frame section comprising:

a base of the frame section defined by a pair of laterally spaced-apart, longitudinally extensive, coplanar, first and second planar elements for mounting the frame section to a structural building element;

a pair of laterally spaced-apart parallel legs, each of the legs longitudinally extensive, and each joined with one of the first and second planar elements, the parallel legs extending away from the base;

a longitudinally extensive leg-joining planar element extensive between, and joined to, the parallel legs;

a longitudinally extensive third planar element joined to the leg-joining planar element and extending away from the base, the third planar element terminating distally from the base, with a plurality of planar rib elements for extending into a drywall compound, the rib elements directed away from the third planar element in an oblique direction towards the base.

2. An open frame assembly apparatus comprising;

at least three extruded, longitudinally extensive, frame sections, each having:

a base of the frame section defined by a pair of laterally spaced-apart, longitudinally extensive, coplanar, first and second planar elements for mounting the frame section to a structural building element;

a pair of laterally spaced-apart planer parallel legs, each of the legs longitudinally extensive, and each joined with one of the first and second planar elements, the parallel legs extending away from the base;

a longitudinally extensive leg-joining planar element extensive between, and joined to, the parallel legs;

a longitudinally extensive third planar element joined to the leg-joining planar element and extending away from the base, the third planar element terminating distally from the base, with a plurality of planar rib elements for extending into a drywall compound, the rib elements directed away from the third planar element obliquely towards the base.

3. The open frame, assembly apparatus of claim 2 further comprising a register mounted on the second planar elements of the frame sections.

4. The open frame assembly apparatus of claim 2 wherein each of the frame sections has a longitudinally extensive fourth planar element joined to the third planar element in a position spaced apart from, and parallel to, the leg-joining planar element, a register mounted on the fourth planar elements of the frame sections.

* * * * *